US011369170B2

(12) United States Patent
Schilling et al.

(10) Patent No.: US 11,369,170 B2
(45) Date of Patent: Jun. 28, 2022

(54) CLASP FOR ITEM OF JEWELRY AND METHODS OF USE

(71) Applicant: LXL Group Inc., Grand Cayman (KY)

(72) Inventors: Frank Schilling, Grand Cayman (KY); David Concepcion, Haileah Gardens, FL (US)

(73) Assignee: LXL Group Inc., Grand Cayman (KY)

( * ) Notice: Subject to any disclaimer, the term of this patent is extended or adjusted under 35 U.S.C. 154(b) by 0 days.

(21) Appl. No.: 16/754,353

(22) PCT Filed: Nov. 27, 2019

(86) PCT No.: PCT/IB2019/060263
§ 371 (c)(1),
(2) Date: Apr. 7, 2020

(87) PCT Pub. No.: WO2020/110054
PCT Pub. Date: Jun. 4, 2020

(65) Prior Publication Data

US 2021/0321729 A1 Oct. 21, 2021

Related U.S. Application Data

(63) Continuation of application No. 29/672,764, filed on Dec. 8, 2018, now Pat. No. Des. 885,243.
(Continued)

(51) Int. Cl.
*A44C 5/20* (2006.01)
*A44C 25/00* (2006.01)

(52) U.S. Cl.
CPC ..... *A44C 5/2042* (2013.01); *A44C 25/007* (2013.01)

(58) Field of Classification Search
CPC ... A44C 5/2042; A44C 25/007; A44C 5/2019; A44C 5/2057; A44C 5/20
See application file for complete search history.

(56) References Cited

U.S. PATENT DOCUMENTS 1,840,896 A * 1/1932 Groh ..... A44B 11/2588 24/701
2,141,251 A * 12/1938 Prestinari ..... A44C 5/2042 24/601.5

(Continued)

FOREIGN PATENT DOCUMENTS

JP 48-042569 5/1973
JP 2002-125727 5/2002

(Continued)

OTHER PUBLICATIONS

International Search Report in International Application No. PCT/IB2019/060263 dated Mar. 4, 2020.

(Continued)

*Primary Examiner* — Jack W Lavinder
(74) *Attorney, Agent, or Firm* — Oppedahl Patent Law Firm LLC

(57) ABSTRACT

The inventive disclosures described herein pertains to an improved clasp-type device for connecting two ends of a wrap-around personal-adornment/jewelry item, such as a necklace, bracelet, or anklet. The improved jewelry clasp provides for both easy and secure coupling of two ends of a wrap-around jewelry item, while providing a decorative "hiding" of the clasp. In variations, the improved jewelry clasp can appear as just one of several ingots/charms that the wrap-around jewelry item may contain. Various other practical applications of the improved jewelry clasp are also disclosed.

42 Claims, 10 Drawing Sheets

Related U.S. Application Data

(60) Provisional application No. 62/704,035, filed on Nov. 29, 2018.

(56) References Cited

U.S. PATENT DOCUMENTS 2,233,071 A * 2/1941 Bangs ..... A44C 5/2071 24/662
2,346,887 A * 4/1944 Winkler ..... A44C 5/20 24/618
3,665,565 A * 5/1972 Kruger ..... A44C 5/2042 24/265 WS
3,900,927 A * 8/1975 D'Angelo ..... A44C 5/2057 24/667
3,936,914 A * 2/1976 Mancini ..... A44B 11/2588 24/684
4,502,192 A * 3/1985 Hess ..... A44B 11/2588 24/589.1
4,524,495 A * 6/1985 Hess ..... A44B 11/2588 24/593.1
4,539,736 A * 9/1985 Yokosuka ..... A44B 11/25 24/265 WS
4,713,864 A * 12/1987 Hess ..... A44C 5/2057 24/589.1
4,998,330 A * 3/1991 D'Amore, Jr. ..... A44C 5/2057 24/116 A
5,774,957 A * 7/1998 Kohl ..... A44C 5/2057 24/616
6,058,576 A * 5/2000 Harris ..... A44C 5/2057 24/20 R
6,539,593 B2 * 4/2003 Morris ..... B63B 17/02 24/265 CD
6,804,868 B2 * 10/2004 Fox ..... A44C 5/2042 24/116 A
D885,243 S * 5/2020 Schilling ..... A44C 5/2042 D11/87
D932,333 S * 10/2021 Schilling ..... D11/13
D932,339 S * 10/2021 Schilling ..... D11/87
2009/0007395 A1 * 1/2009 Ida ..... A44B 11/263 24/163 R
2014/0245792 A1 * 9/2014 Kienzle ..... A44C 5/2042 63/14.4
2021/0153611 A1 * 5/2021 Oganesian ..... A44C 5/2033

FOREIGN PATENT DOCUMENTS

JP 3089087 10/2002
KR 10-2006-0093320 A 8/2006

OTHER PUBLICATIONS

Written Opinion in International Application No. PCT/IB2019/060263 dated Mar. 4, 2020.

* cited by examiner

CLASP FOR ITEM OF JEWELRY AND METHODS OF USE

CROSS-REFERENCE TO RELATED APPLICATIONS

The present patent application claims the priority benefit of U.S. Patent Application No. 62/704,035, filed on Nov. 29, 2018 for "Clasp for jewelry," and also claims the priority benefit of U.S. patent application Ser. No. 29/672,764, filed on Dec. 8, 2018 for "Clasp for jewelry item." In addition, the present patent application hereby incorporates by reference both U.S. Patent Application No. 62/704,035 and U.S. patent application Ser. No. 29/672,764 in their entirety for all purposes. For purposes of claim construction, if there are any unresolvable inconsistencies between the teaching of the present patent application and either U.S. Patent Application No. 62/704,035 and/or U.S. patent application Ser. No. 29/672,764, then the teachings of the present patent application shall govern.

BACKGROUND

The present inventive disclosure pertains to a clasp for connecting two ends of a necklace, bracelet, or anklet; that is, an "item of jewelry." Most necklaces, bracelets, and anklets are comprised of some form of chain, string, other cordage (e.g., leather strips, ribbon, etc.), or a series of linked ingots or charms, that have two ends that are connected with some form of dedicated mechanical-connector device, and may or may not also include one or more adornment members attached to said chain, string, or other cordage. Hereinafter and for simplicity, said chain, string, other cordage, or a series of linked ingots or charms for an item of jewelry is collectively referred to as "a chain for an item of jewelry" and is intended to encompass any of the chains, string, other cordage, or linked ingots or charms that an item of jewelry might employ.

The aforementioned dedicated mechanical-connector device, typically referred to as a "clasp," or "jewelry fastener," is the mechanism that allows a necklace or bracelet to easily be put on and taken off without causing any damage. Some fasteners are meant to be hidden or rotated out of sight, while others are a key element to the design. Such clasps employed by most necklaces, bracelets, and anklets usually takes the form of any of the following:

- Ball Clasp (also known as a bead clasp): A ball clasp is a round, spherical jewelry fastener that is sometimes adorned with gemstones or texturing. A ball clasp typically has an "eye" extending form the "ball" in which a bent hook coupler can engage. The actual coupler in a ball clasp is fully exposed and lacks security.
- Barrel Clasp: A barrel clasp is a small barrel or torpedo-shaped closure that fastens two ends together through a screw, box, or hook-insert mechanism. While this type of jewelry clasp generally provides more security than a ball clasp, a barrel clasp can be unsightly.
- Fishhook Clasp: A fishhook clasp is a delicate fastener that involves a hook inserted into an encasing and is commonly used for lightweight necklaces and bracelets and can be relatively easily decoupled; that is, the coupling is somewhat insecure.
- Hook Clasp: A hook clasp uses an easy hook-on, hook-off motion, wherein a curved piece at the bottom of the hook catches onto a loop or circle to hold it in place. This type of coupling can be easily inadvertently uncoupled.

- Lobster Clasp: A lobster clasp is named after the pinching style of the hook, which resembles a lobster claw, which engages a loop or circle. Its lever is exercised to open the clasp in order to open the clasp and the lever is released to close the clasp. Many view this type of clasp as unsightly, especially when a necklace or bracelet rotates such that the lobster clasp is visible.
- Swivel Clasp: A swivel clasp is a variant of a lobster clasp in that it can swivel 360 degrees at its base.
- Push-Button Clasp: A push-button clasp has a female receptacle and a male member that "clicks" into the female receptacle. The mechanism relies on a lever or button that must be pushed to release the clasp. This type of clasp usually does not match well with the balance of the jewelry item, especially when a necklace or bracelet rotates such that the push-button clasp is visible.
- Springring Clasp: A springring clasp is a hollow circular metal fastener with a spring opening that keeps the clasp closed. Many consider this type of clasp as unsightly and it does not match well with the balance of the jewelry item, especially when a necklace or bracelet rotates such that the springring clasp is visible.
- Buckle Clasp; A buckle clasp is sometimes used as a clasp for leather or material bracelets. A buckle clasp features the same mechanism as a classic belt buckle, wherein the buckle straps one end through a loop and secures it with a hinged prong that inserts into a hole and rests against a metal frame. This specialized clasp is generally inappropriate aesthetically for most applications for necklaces, bracelets, and anklets.
- Ladder Clasp: A ladder clasp is an old-fashioned fastener often used for wristwatches. With one end-piece resembling a two-spoke ladder, the fold-over side can be hooked into one of two slots to adjust size. The size and look of this type of clasp is generally inappropriate for most necklaces, bracelets, and anklets.
- Slide Clasp: A slide clasp secures closure with two bars, each having one or more eyelets for attaching to chains, cords, or the like, wherein one of the bars slides into the other, which has a slot to allow the eyelet(s) of the interior bar to extend outside of the interlocked bars. This type of clasp is very specialized and is relatively large and intended for thick necklaces with more than one chain, cord, strand, etc.
- Magnetic Clasp: A magnetic clasp relies on a magnet to hold ends of the necklace, bracelet, or anklet together, allowing for easy-on, easy-off closure. However, depending on the strength of the magnets, this type of clasp may lack the level of security many users desire.
- Toggle Clasp: A toggle clasp is a two-piece jewelry fastener that closes when a t-shaped or decorative bar is threaded through a circular loop. This stylized clasp type often serves as the centerpiece of a design for specialized jewelry items and is not intended to be hidden from view.

The aforementioned (and other) prior-art clasp arrangements are not necessarily space filling, but in many designs, they have voids or hollow areas. Such voids or hollow areas can led to the misalignment of moving parts and might not provide an overall elegant geometric shape, but instead a shape with openings or hollows that can make a clasp more difficult for a user as well as one that is less appealing in its general look and feel to a user. In addition, most prior-art clasp arrangements have overall shapes that are not cylindrical but are instead rectangular or made up of other flat faces.

Each of the aforementioned clasp types has securement issues or is unsightly with respect to the balance of the item of jewelry. Hence, the present inventive disclosure is intended to disclose an improved type of clasp (and associated applications) that address both of these issues.

BRIEF SUMMARY

The inventive disclosures described herein pertains to a clasp for connecting two ends of an item of jewelry, such as a necklace, bracelet, or anklet. The clasp provides for both easy and secure coupling of two ends of an item of jewelry, while providing a decorative "hiding" of the clasp. In variations, the clasp can appear as just one of several ingots or charms that the item of jewelry may contain.

The foregoing Brief Summary is intended to merely provide a short, general overview of the inventive disclosures described throughout this patent application, and therefore, is not intended to limit the scope of the inventive disclosure contained throughout the balance of this patent application, including the appended claims and drawings.

DETAILED DESCRIPTION

I. Overview

Figure 1:
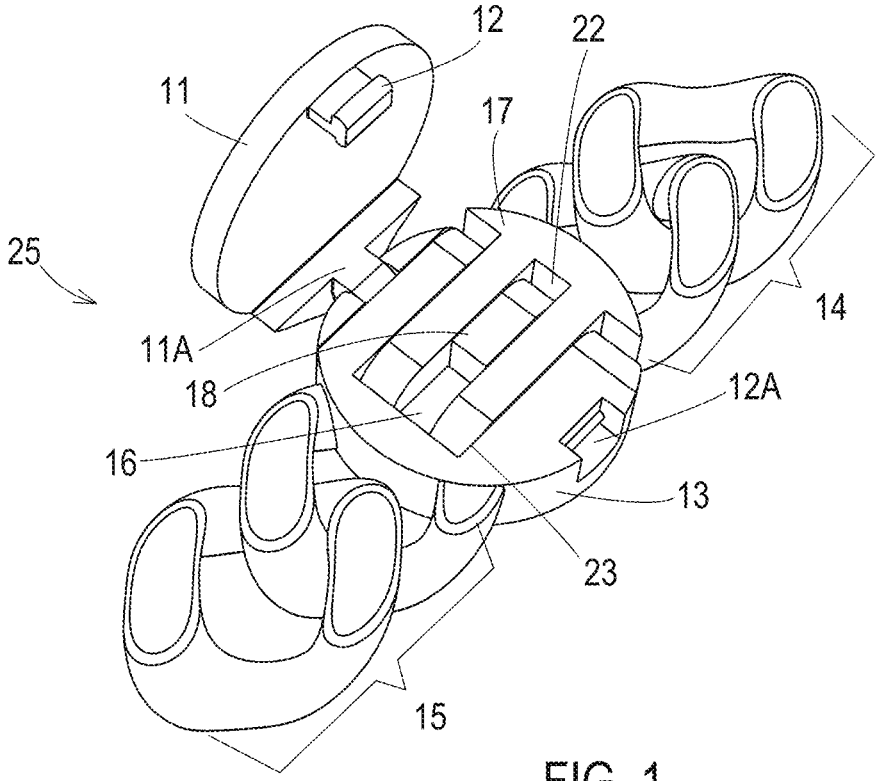
FIG. 1 is a right-front isometric view of a clasp with the clasp cover open.
Figure 2:
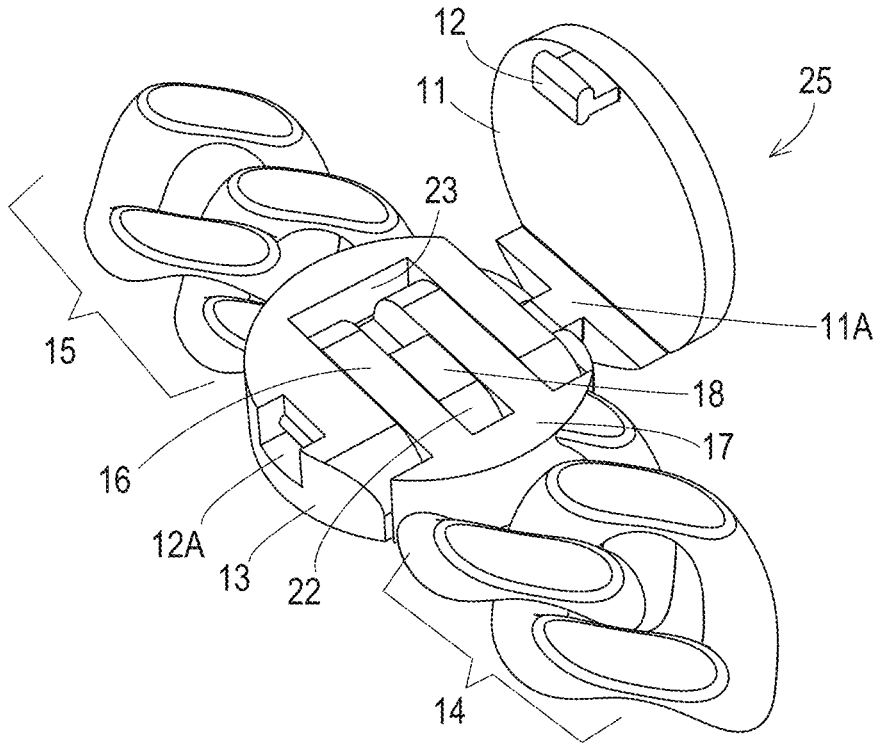
FIG. 2 is a left-front isometric view of the clasp with the clasp cover open.
Figure 3:
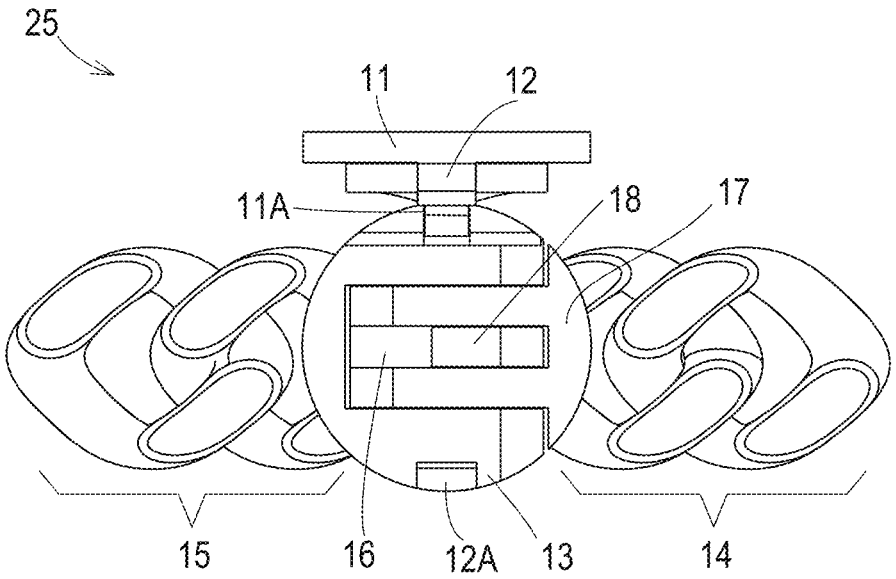
FIG. 3 is a top view of the clasp with the clasp cover open.
Figure 4:
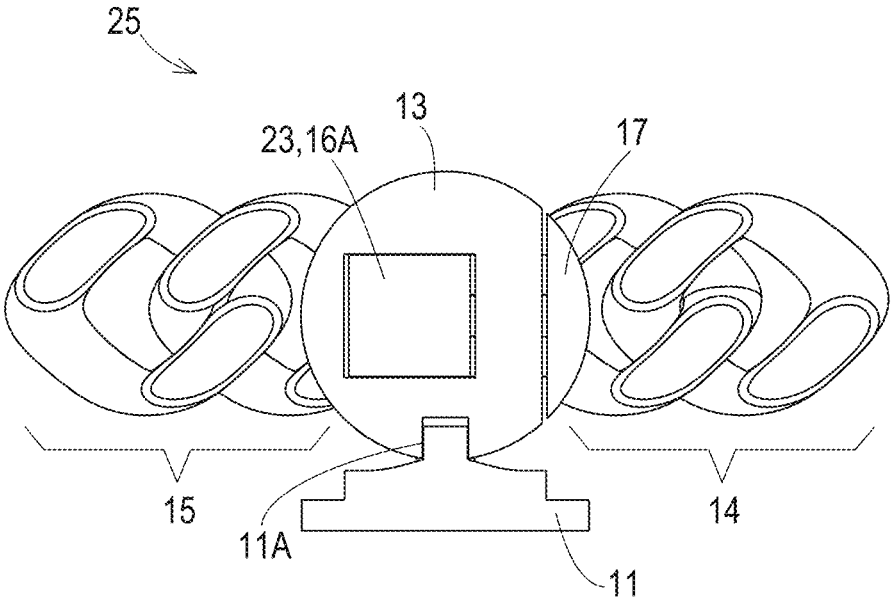
FIG. 4 is a bottom view of the clasp with the clasp cover open.
Figure 5:
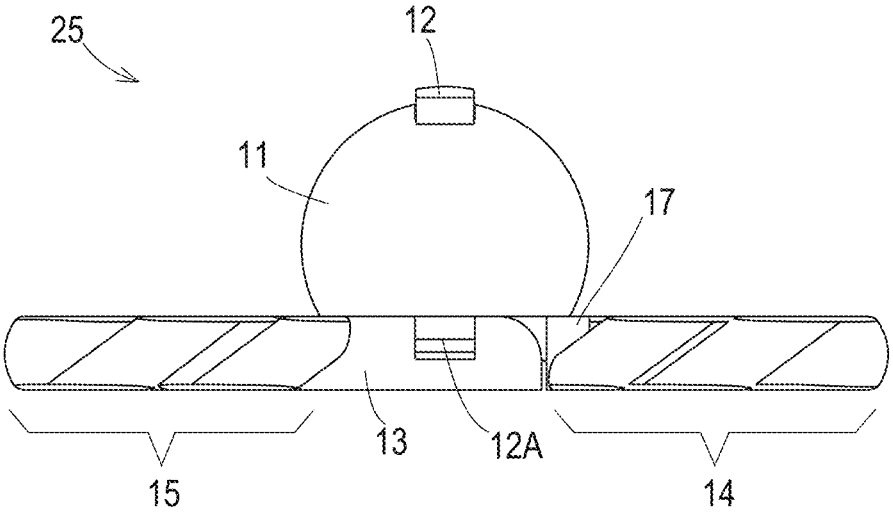
FIG. 5 is a front view of the clasp with the clasp cover open.
Figure 6:
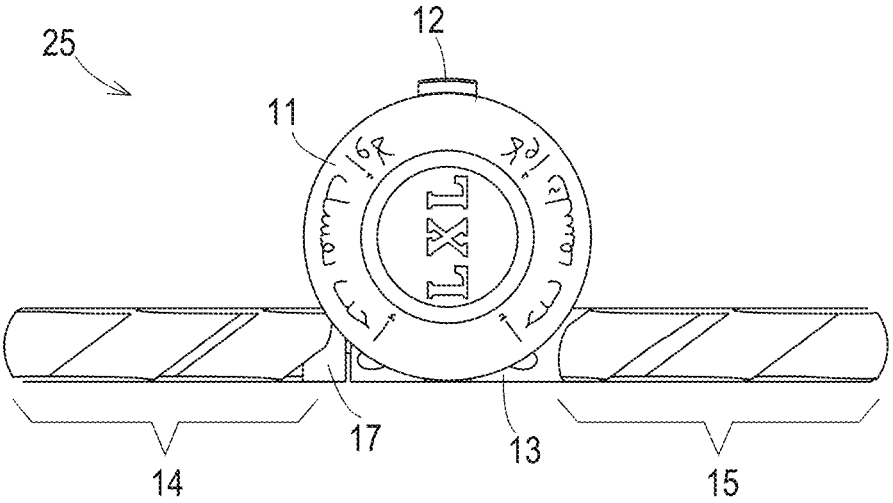
FIG. 6 is a rear view of the clasp with the clasp cover open.
Figure 7:
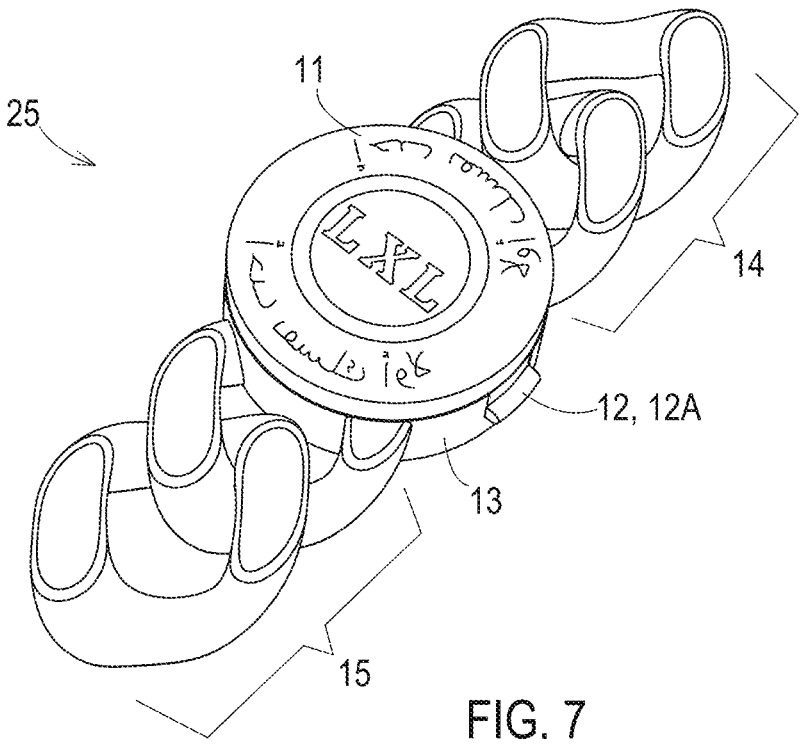
FIG. 7 is a right-front isometric view of the clasp with the clasp cover closed.
Figure 8:
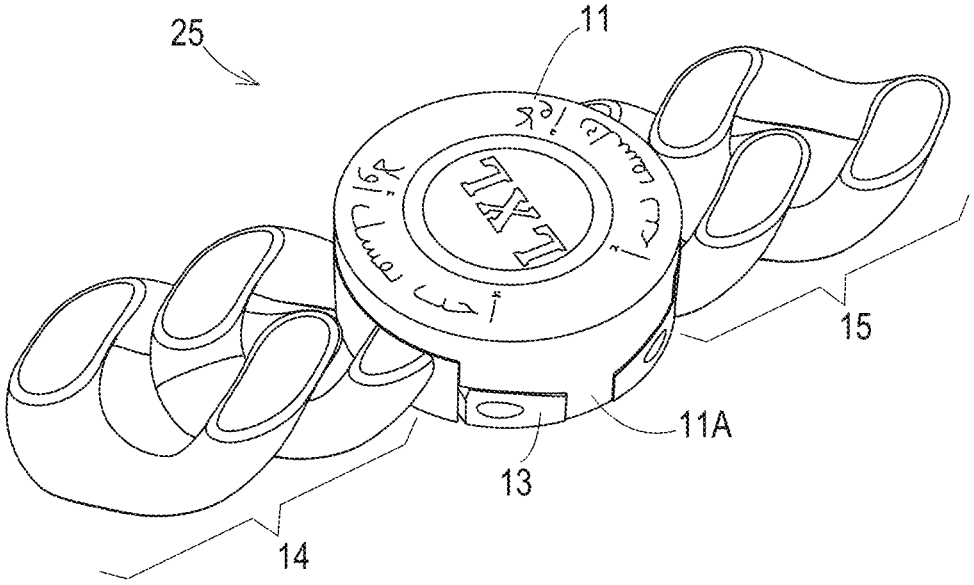
FIG. 8 is a left-rear isometric view of the clasp with the clasp cover closed.
Figure 9:
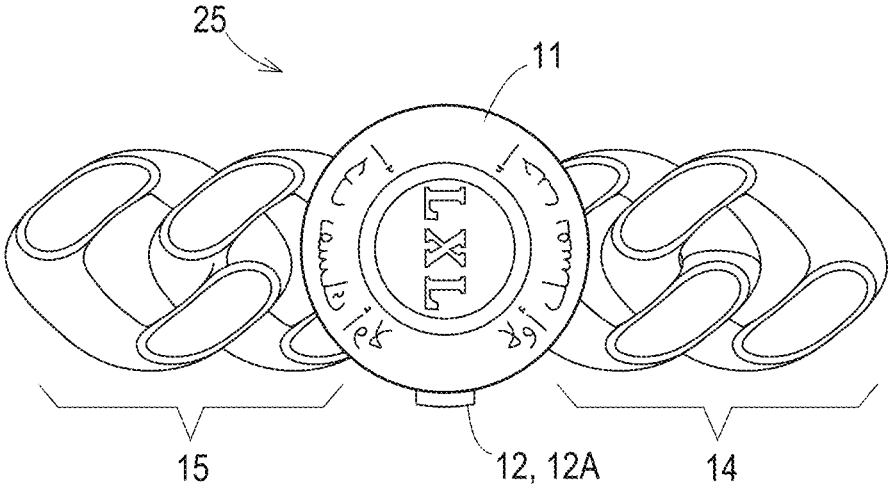
FIG. 9 is a top view of the clasp with the clasp cover closed.
Figure 10:
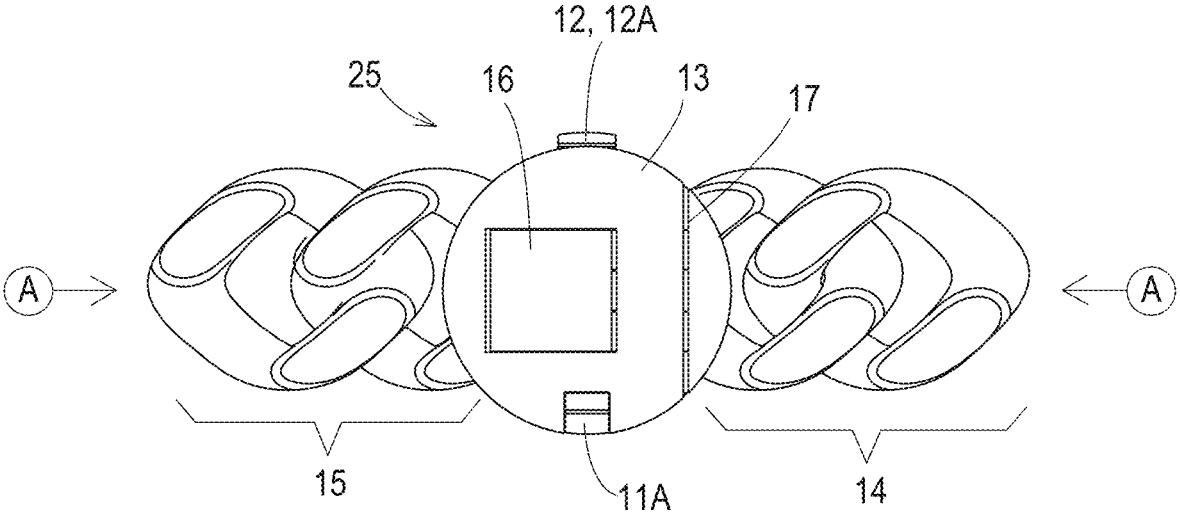
FIG. 10 is a bottom view of the clasp with the clasp cover closed.
Figure 11:
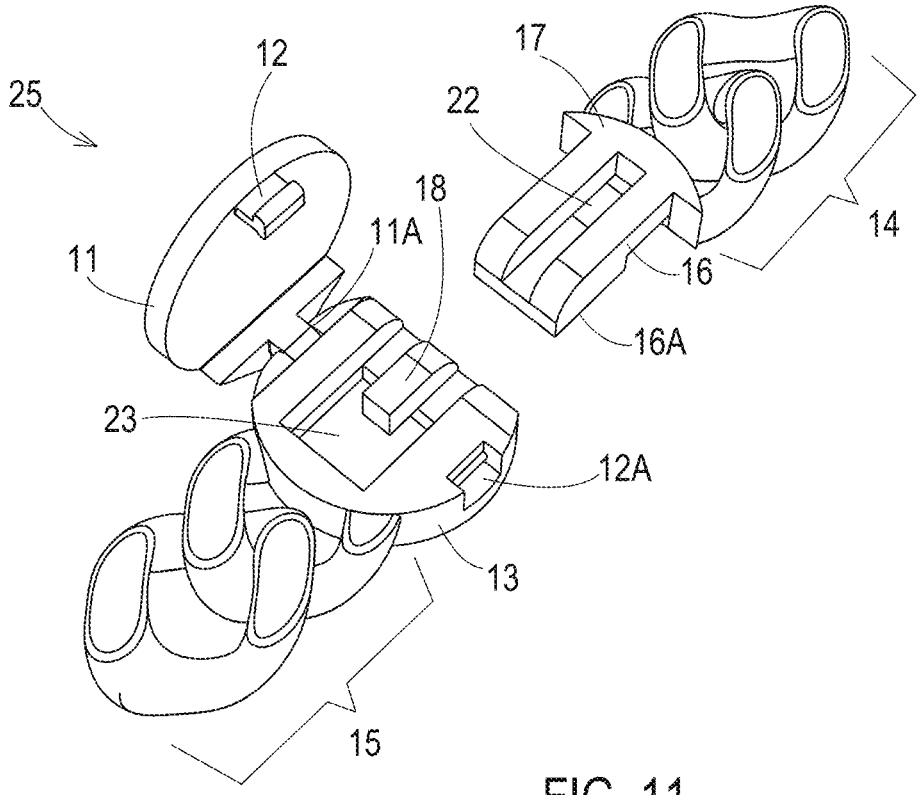
FIG. 11 is a right-front isometric view of the clasp with the clasp cover open and the clasp disengaged.
Figure 12:
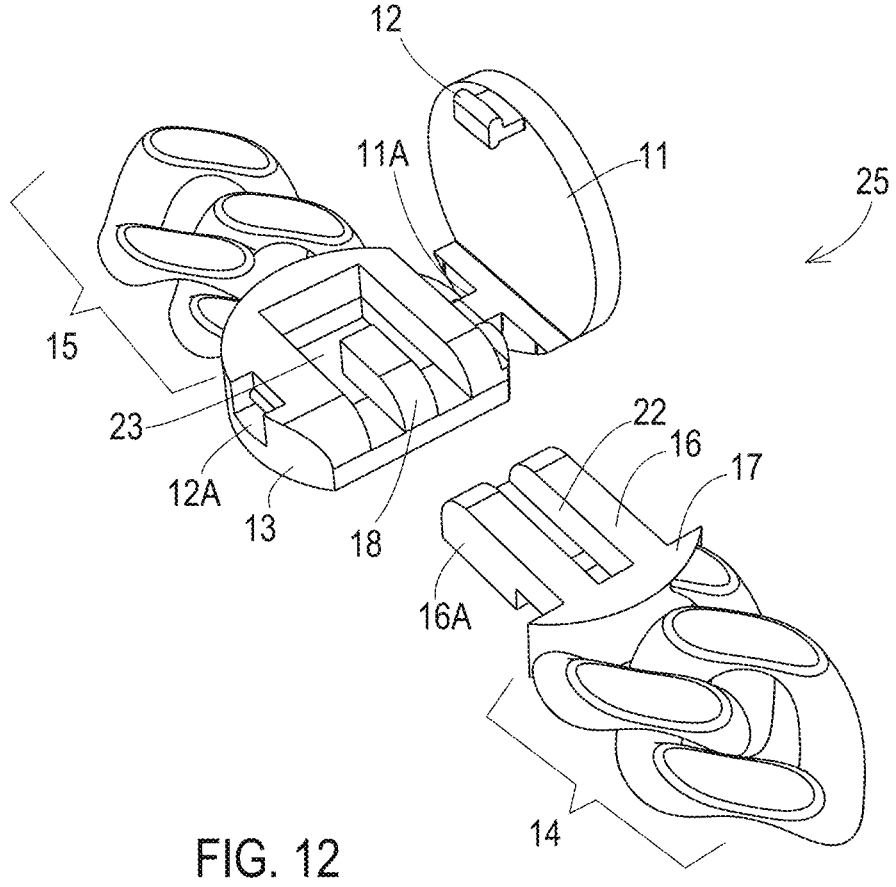
FIG. 12 is a left-front isometric view of the clasp with the clasp cover open and the clasp disengaged.
Figure 13:
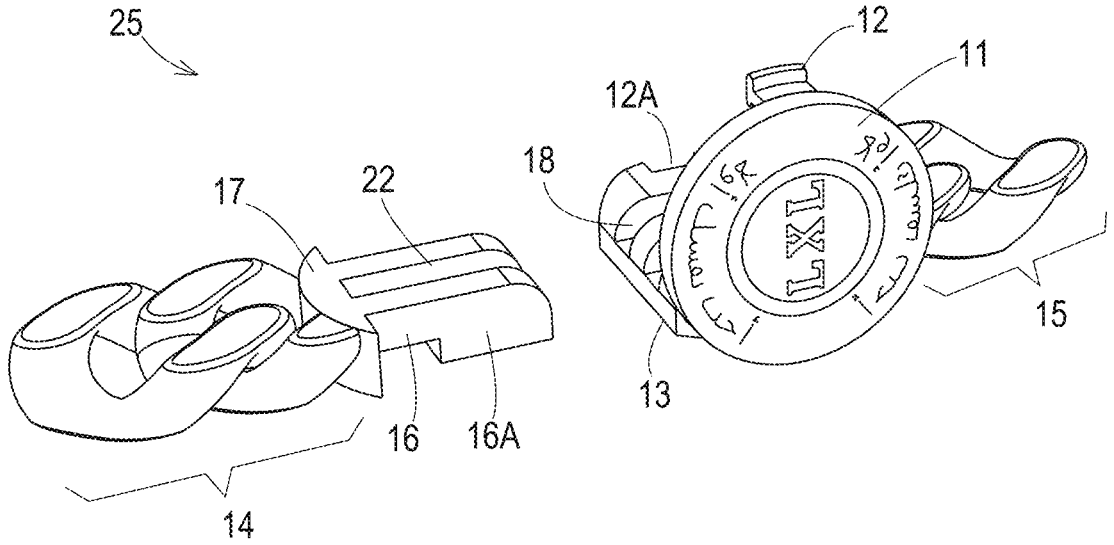
FIG. 13 is a left-rear isometric view of the clasp with the clasp cover open and the clasp disengaged.
Figure 14:
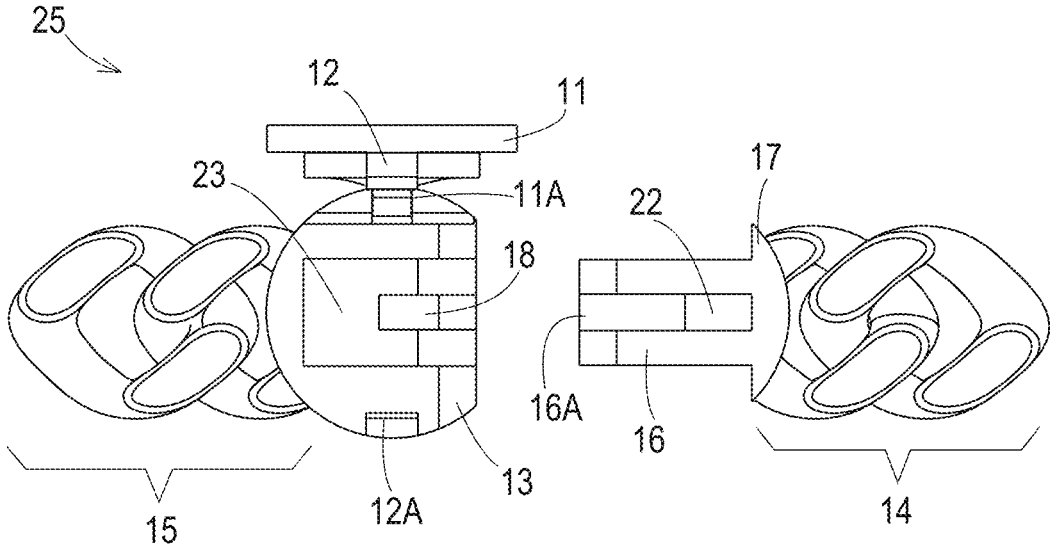
FIG. 14 is a top view of the clasp with the clasp cover open and the clasp disengaged.
Figure 15:
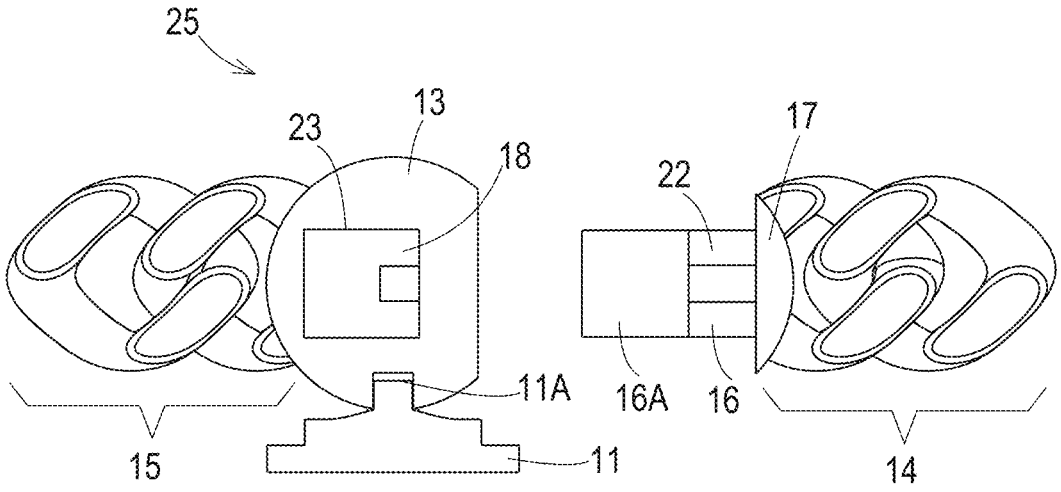
FIG. 15 is a bottom view of the clasp with the clasp cover open and the clasp disengaged.
Figure 16:
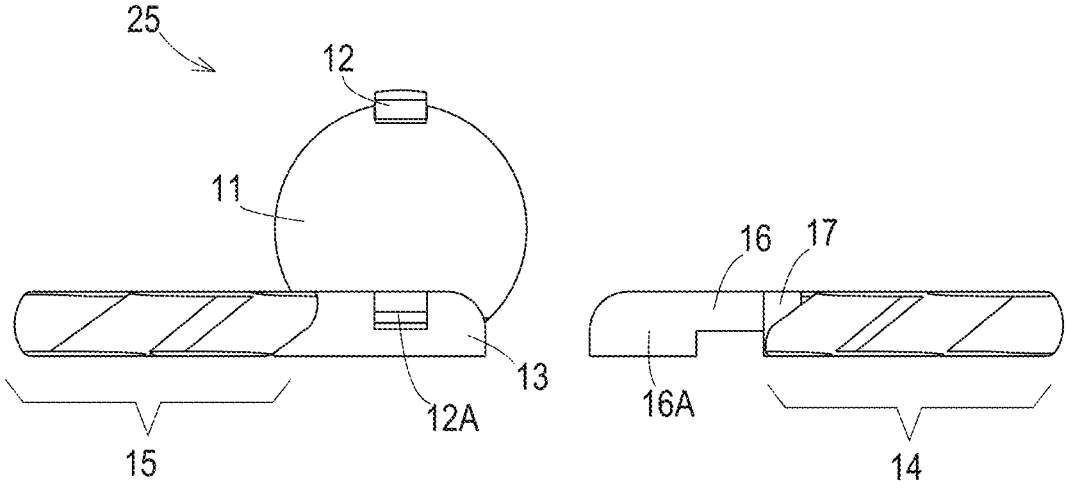
FIG. 16 is a front view of the clasp with the clasp cover open and the clasp disengaged.
Figure 17:
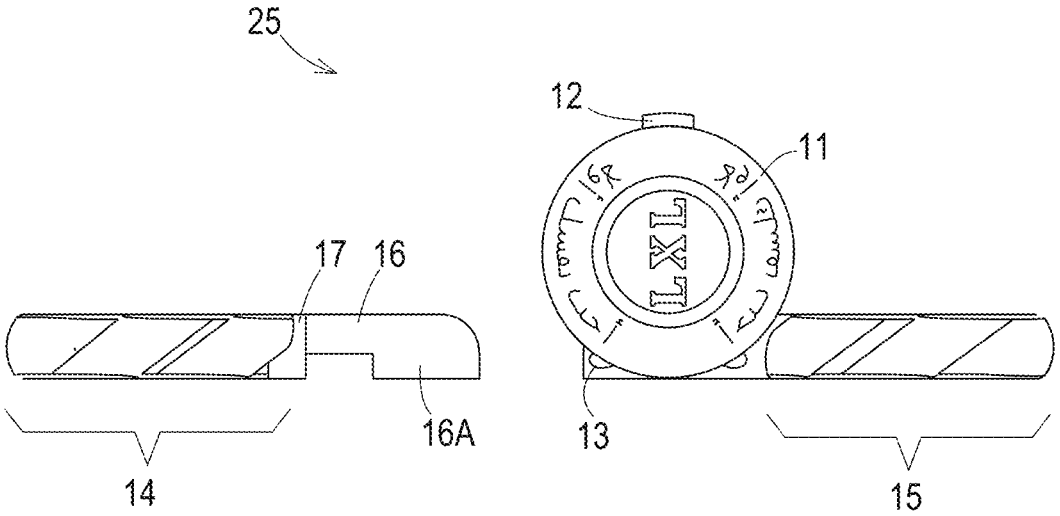
FIG. 17 is a rear view of the clasp with the clasp cover open and the clasp disengaged.

The inventive disclosures described herein pertains to a clasp for connecting two ends of an item of jewelry, such as a necklace, bracelet, or anklet. The clasp provides for both easy and secure coupling of two ends of the item of jewelry, while providing a decorative "hiding" of the clasp. In variations, the clasp can appear as just one of several ingots or charms that the item of jewelry may contain.

II. Terminology

The terms and phrases as indicated in quotes (" ") in this Section are intended to have the meaning ascribed to them in this Terminology Section applied to them throughout this document, including the claims, unless clearly indicated otherwise in context. Further, as applicable, the stated definitions are to apply, regardless of the word or phrase's case, to the singular and plural variations of the defined word or phrase.

The term "or", as used in this specification, drawings, and the appended claims, is not meant to be exclusive; rather, the term is inclusive, meaning "either or both".

References in the specification to "one embodiment", "an embodiment", "a preferred embodiment", "an alternative embodiment", "a variation", "one variation", and similar phrases mean that a particular feature, structure, or characteristic described in connection with the embodiment is included in at least an embodiment of the invention. The appearances of the phrase "in one embodiment" and/or "in one variation" and similar phrases in various places in the specification are not necessarily all meant to refer to the same embodiment.

The term "couple" or "coupled", as used in this specification, drawings, and the appended claims, refers to either an indirect or a direct connection between the identified elements, components, or objects. Often, the manner of the coupling is related specifically to the manner in which the two coupled elements interact.

The term "removable", "removably coupled", "readily removable", "readily detachable", "detachably coupled", and similar terms, as used in this specification, drawings, and the appended claims, refer to structures that can be uncoupled from an adjoining structure with relative ease (i.e., non-destructively and without a complicated or time-consuming process) and that can also be readily reattached or coupled to the previously adjoining structure.

Directional or relational terms such as, but not limited to, left, right, nadir, apex, top, bottom, vertical, horizontal, back, front, lateral, proximal, and distal are relative to each other, are dependent on the specific orientation of an applicable element or article, are used accordingly to aid in the description of the various embodiments, and are not necessarily intended to be construed as limiting in this specification, drawings, and the appended claims.

As applicable, the terms "about" or "generally", as used herein unless otherwise indicated, means a margin of +−20%. Also, as applicable, the term "substantially" as used herein unless otherwise indicated means a margin of +−10%. It is to be appreciated that not all uses of the above terms are quantifiable such that the referenced ranges can be applied.

The terms "item of jewelry" or "wrap-around jewelry item," as used in this specification, drawings, and the appended claims, are each intended to be a generic reference to any kind of necklace, bracelet, or anklet that a person may wear.

The terms "chain for an item of jewelry," "chain for a wrap-around jewelry item," and similar terms, as used in this specification, drawings, and the appended claims, are intended, for simplicity, to also include alternatives for a chain; that is, a chain (or plurality of chains), a string, other cordage, or linked ingots/charms. Therefore, it is to be understood by a person of ordinary skill in the art that a reference to a "chain for an item of jewelry," "chain for a wrap-around jewelry item," or similar term that are connected to a clasp as described herein includes alternative embodiments where a literal chain may be instead substituted with string, other cordage, etc.

III. A Clasp for an Item of Jewelry

This Section is directed generally to a clasp for connecting two ends of a wrap-around jewelry item, such as a necklace, bracelet, or anklet. The clasp provides for both easy and secure coupling of two ends of an item of jewelry, while providing a decorative "hiding" of the clasp, as it can appear as just one of several ingots or charms that form part of the item of jewelry.

An exemplary clasp 25 is shown generally in FIGS. 1-21. The clasp 25 is comprised of a main body 13 that is configured to mate with a tongue 16, 17. The main body 13 and tongue 16, 17 may be most easily seen and appreciated in FIGS. 11-17 where they appear separately from each other.

With particular reference to FIGS. 11-17, the tongue 16, 17 comprises a base 17 and a mating projection 16. The tongue 16, 17 is adapted to be received by a through-hole 23 in the main body 13. The tongue mating projection 16 may include two extended members separated by a space 22 that is sized to closely receive a protrusion 18 in the main body 13. This may be seen for example in FIG. 11. The extended members 16 of the tongue mating projection are joined together by a member 16A at the bottom and distal (relative to the tongue base 17) end of the extended members 16 of the tongue mating projection, visible for example in FIG. 11. In this way, when the tongue 16, 17 is fully inserted and seated in the main body 13, the protrusion 18 of the main body 13 overlaps the joining member 16A of the tongue mating projection's 16 extended members in order to provide additional security for the coupling, and the joining member 16A of the tongue mating projection 16 substantially fills the through-hole 23 in the main body 13 such that the tongue 16, 17 and main body 13 form a substantially space-filling flat bottom surface. This may be seen for example in FIGS. 4, 10 and 17 and the space-filling flat bottom face is best appreciated in FIG. 4.

Figure 18:
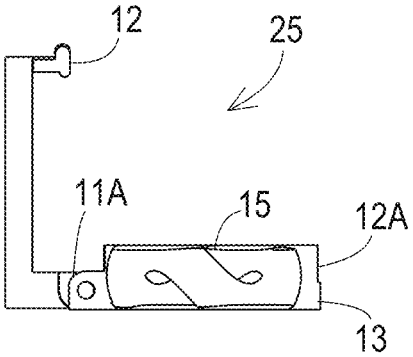
FIG. 18 is a right-side view of the clasp with the clasp cover open.
Figure 19:
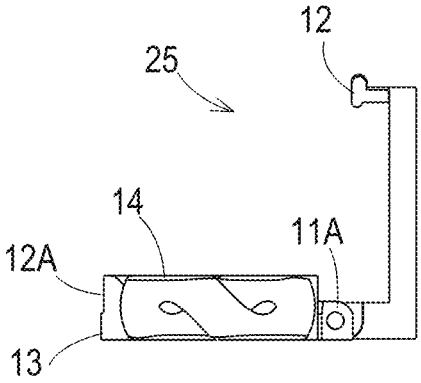
FIG. 19 is a left-side view of the clasp with the clasp cover open.

In an embodiment, the tongue 16, 17 and main body 13, when fully engaged, form a flat/flush upper surface so that a locking cover 11 can fully close against the top surface of the body 13. The locking cover 11 may include a hinge 11A coupled to the rear of the main body 13 and may include a locking tab or "nib" 12 that is adapted to engage via interference fit with a locking-tab-receiving cavity 12A disposed at the front side of the main body 13. FIGS. 18 and 19 show this particularly clearly.

The top-right side edges of the main body 13 may be sloped downward to help facilitate the initial engagement with the tongue 16, 17. This may be seen particularly clearly in FIG. 12. Similarly the edges at the top-distal end of the tongue mating projection 16 may be sloped downward to help facilitate easier insertion of the tongue 16, 17 into the main body 13 via through-hole 23. This may be seen particularly clearly in FIG. 11.

The right side of the main body 13 may be adapted to be coupled to one end of a chain for a wrap-around jewelry item 15, and the base of the tongue 17 may be adapted to be coupled to the other end of a chain for a wrap-around jewelry item 14. Depending on the type of "chain" used (see the definitions in Section II, "Terminology"), this coupling can be by welding, clamping, tying, and any other form of coupling known in the jewelry industry.

Figure 20:
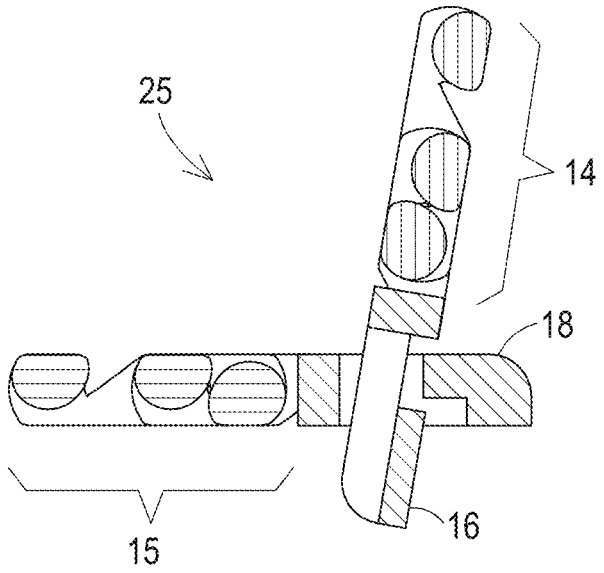
FIG. 20 is a partial cross-section view of the clasp with the tongue inserted part way into the main body.
Figure 21:
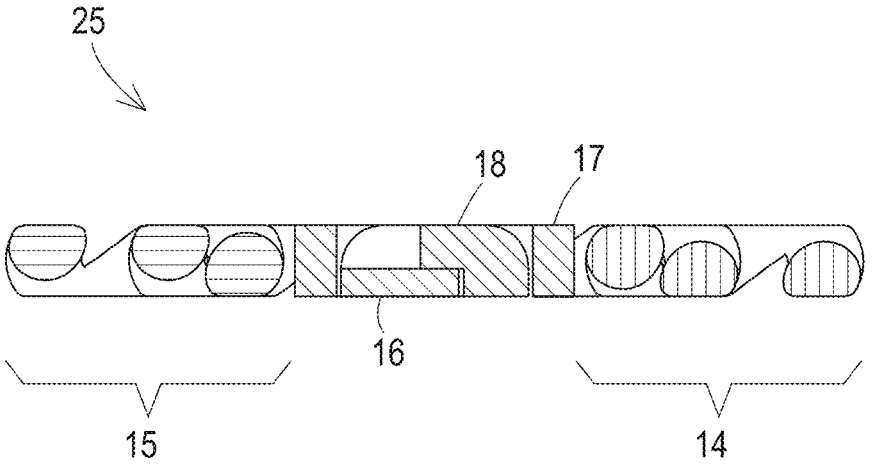
FIG. 21 is a cross-section view of the clasp with the tongue seated in place in the main body.

Returning briefly to FIG. 10, cross-section lines A are shown, indicating a plane in which cross section and partial cross sections in FIGS. 20 and 21 are taken. We can then discuss in some detail the steps to be followed by the user when engaging the clasp 25. As shown in FIG. 20, when engaging the clasp 25, the locking cover 11 (omitted for clarity in FIG. 20) on the main body is opened and a user inserts the mating projection 16 of the tongue into the through-hole 23. There is just barely enough room for the projection 16 to slip past the protrusion 18 and downwards as shown in FIG. 20. Protrusion 18 is shown in cross section in FIG. 20 and tongue 16 is shown in full rather than in cross section, to assist the reader in appreciating the path followed by the tongue 16 when it is inserted through the though-hole 23.

The user then pivots the tongue 16, 17 downward as shown in FIG. 21 where the tongue 16, 17 is seated into place. In FIG. 21 both the protrusion 18 and the tongue 16 are shown in cross section. Depending on the exact dimensions of the various parts, the user may then slip the tongue slightly toward the right side of the main body 13 so that the tongue base 17 can slip past the sloped edges and the tongue 16, 17. The tongue engages with the protrusion 18 of the main body 13. Once the tongue 16, 17 is fully engaged and seated, a substantially flat upper surface is formed with the main body 13. This is most clearly seen in FIGS. 1-3. This in turn allows the cover 11 to be fully closed over the coupled tongue 16, 17 and main body 13. The configuration with the closed cover 11 may be seen for example in FIGS. 7-10. The cover 11 is latched via the locking tab 12 and locking-tab-receiving cavity 12A.

The opposite procedure is used to open and disengage the clasp 25. The cover 11 is opened. The tongue 16, 17 is rotated as shown in FIG. 20. The tongue 16, 17 may then be withdrawn from the main body 13. The tongue 16, 17 is then separate from the main body 13 as is depicted in FIGS. 11-14.

It should be appreciated that when engaged, any attempt to pull apart the clasp 25, even with the cover 11 open as depicted in FIGS. 1-4, results in the protrusion 18 further engaging the joining member 16A of the tongue mating projection 16, thus greatly inhibiting, if not fully preventing inadvertent decoupling of the clasp 25 short of catastrophic mechanical failure.

A particularly interesting embodiment for the item of jewelry incorporates multiple charms or ingots, and the main body 13 and the cover 11 of the clasp 25 are sized, shaped, and ornamented to look like one of the charms/ingots in order to effectively conceal which charm or ingot on the item of jewelry contains the clasp 25. In this sense, it will be appreciated by the alert reader that there may be decoration, writing, or iconography on the charms/ingots and on the clasp 25. Such decoration, writing or iconography is best appreciated for example in FIGS. 6-9 and 13 and 17.

In one extreme example, all of the charms or ingots and the clasp 25 are identically ornamented or bear identical writing or iconography. In another example, in the case where every charm ingot is in fact a clasp 25, a user can assemble a custom item of jewelry chain that is non-identical to an item of jewelry that anyone else might be wearing, with combinations of icons or writing on the various clasps 25 or charms or ingots that are uniquely selected by the user (for example, a user-constructed charm bracelet). In such cases, a user can assemble one arrangement for wear at one event and a different arrangement to wear at a different event.

In another embodiment, multiple clasps 25 are incorporated in a single item of jewelry; that is, multiple lengths of chain 14, 15 are used and coupled via a clasp 25 such that the effective length of the item of jewelry can be varied by a user by adding or removing one of more lengths of chain and an associated clasp 25. In an extreme case, every charm or ingot in an item of jewelry (e.g., a necklace) could also incorporate a clasp 25, which allows a user to insert or remove lengths of chain to vary the overall length and size of the item of jewelry. The alert reader will appreciate that the jewelry item may include any number of lengths of chain 14, 15 coupled with any number or combination of clasps or charms or ingots.

In another embodiment, the clasp 25 is incorporated in a Cuban link chain. The clasp 25 design is well suited for use with jewelry made of nearly pure precious metals such as nearly pure gold, silver, or platinum because of the clasp's 25 relatively simple and uncomplicated and reliable design, which does not require alloys to provide great strength or great rigidity. Even though some nearly pure precious metals are somewhat soft and somewhat malleable, the clasp 25 design offers very reliable functionality that does not require finely structured features. For example, if the piece parts such as the main body 13 or tongue 16, 17 were to deform slightly due to the somewhat the soft and somewhat malleable nature of the precious metals of which they might be comprised, the simple and reliable design offers its benefits including the low likelihood of the clasp coming loose. In one variation, a suitable choice of fabrication metal for the clasp 25 is 24-karat gold.

In some embodiments of the clasp 25, the main body 13 can be made with a two-part mold or can be made with a simple gravity-fed lost-wax molding technique. For gravity-fed lost-wax molding techniques, the lost-wax forms can be very easily fabricated, either by simple two-part molds, or with simple additive manufacturing, or by the simple milling of wax blocks or forms. The same may be said of the tongue 16, 17 for the clasp 25. This is in contradistinction to many known clasps in the prior art, wherein a main body must itself be assembled from two or more parts that need to be joined together to form the main body. It is likewise in contradistinction with many known clasps in the prior art wherein complicated milling processes must be undertaken to construct the main body from larger blocks.

IV. Alternative Embodiments and Other Variations

The various embodiments and variations thereof described herein, including the descriptions in any appended claims and/or illustrated in the accompanying Figures, are merely exemplary and are not meant to limit the scope of the inventive disclosure. It should be appreciated that numerous variations of the invention have been contemplated as would be obvious to an alert reader with the benefit of this disclosure. Hence, the alert reader will have no difficulty devising myriad obvious variations and improvements to the invention, all of which are intended to be encompassed within the scope of the Description, Claims, and Figures herein.

The invention claimed is:

1. A connecting method for use with a main body and a tongue, the tongue having a respective shape and the main body having a respective shape, the tongue disposed to stand proud of a first external structure connected thereto, the main body and tongue each defining a respective near face and a respective far face, the main body defining a respective hole, the tongue defining a respective hole, the main body defining first and second ends, the main body disposed to be connected to a second external structure at the first end of the main body, the main body having a protrusion based at the second end and protruding into the respective hole of the main body and toward the first end, the protrusion being nearer the near face of the main body than the far face of the main body, the tongue with the respective hole of the tongue defining a first portion of the tongue that is nearer the far face of the tongue than the near face of the tongue, the main body having a hinged cover disposed to be moved toward the respective hole of the main body and shaped generally to cover a portion of the respective hole of the main body, the hinged cover further defining a latch holding the hinged cover in place as it covers a portion of the respective hole of the main body, the method comprising the steps of:

juxtaposing the main body and the tongue between the first external structure and the second external structure, the tongue standing proud of the first external structure toward the main body, the main body extending from the second external structure toward the tongue, with the tongue located near the second end of the main body and away from the first end of the main body, the near face of the main body and the near face of the tongue facing the same way, the far face of the main body and the far face of the tongue facing the same way;

moving the tongue toward the main body;

inserting the tongue into the respective hole of the main body;

positioning the tongue so that the protrusion protrudes into the respective hole of the tongue and so that the first portion of the tongue is nearer the far face of the main body than the near face of the main body, whereby from a perspective from which the near faces of the main body and the tongue are visible, the first portion of the tongue is further away than the protrusion of the main body, and whereby from a perspective from which the near faces of the main body and the tongue are visible, the first portion of the tongue is behind the protrusion of the main body, whereby the protrusion of the main body penetrates into the respective hole of the tongue;

rotating the tongue relative to the main body until the near face of the tongue is substantially parallel to the near face of the main body, whereby the tongue is seated within the main body;

moving the hinged cover toward the respective hole of the main body and latching it into place, thereby covering a portion of the respective hole of the main body and thereby covering a portion of the tongue.

2. The connecting method of claim 1 further characterized in that the shape of the tongue and the shape of the main body are such that when the tongue is seated within the main body, the tongue and the main body are substantially space-filling, whereby the far faces of the tongue and the main body together make up a nearly flat face, and whereby the near faces of the tongue and the main body together make up a nearly flat face, and the tongue and the main body together make up a nearly cylindrical shape.

3. The connecting method of claim 2 further characterized in that the shape of the hinged cover is substantially cylindrical, whereby when the tongue is seated within the main body, and when the hinged cover is latched into place, the tongue, the main body, and the hinged cover together make up a nearly cylindrical shape.

4. A disconnecting method for use with a main body and a tongue, the tongue having a respective shape and the main body having a respective shape, the tongue disposed to stand proud of a first external structure connected thereto, the main body and tongue each defining a respective near face and a respective far face, the main body defining a respective hole, the tongue defining a respective hole, the main body defining first and second ends, the main body disposed to be connected to a second external structure at the first end of the main body, the main body having a protrusion based at the second end and protruding into the respective hole of the main body and toward the first end, the protrusion being nearer the near face of the main body than the far face of the main body, the tongue with the respective hole of the tongue defining a first portion of the tongue that is nearer the far face of the tongue than the near face of the tongue, the main body having a hinged cover disposed to be moved toward the respective hole of the main body and shaped generally to cover a portion of the respective hole of the main body, the hinged cover further defining a latch holding the hinged cover in place as it covers a portion of the respective hole of the main body, the tongue seated within the main body with the near face of the tongue facing the same way as the near face of the main body and with the far face of the tongue facing the same way as the far face of the main body, the shape of the tongue and the shape of the main body such that with the tongue seated within the main body, from a perspective from which the near faces of the main body and the tongue are visible, the first portion of the tongue is behind the protrusion of the main body, the shape of the tongue and the shape of the main body such that with the tongue seated within the main body, from a perspective from which the near faces of the main body and the tongue are visible, the protrusion of the main body protrudes into the respective hole of the tongue, the hinged cover latched into place and covering the portion of the respective hole of the main body, the shape of the tongue and the shape of the main body such that the tongue and the main body are substantially space-filling, the far faces of the tongue and the main body together making up a nearly flat face, the near faces of the tongue and the main body together making up a nearly flat face, the tongue and the main body together making up a nearly cylindrical shape, and the shape of the hinged cover being substantially cylindrical, such that the tongue, the main body, and the hinged cover together make up a nearly cylindrical shape, the method comprising the steps of:

unlatching and opening the hinged cover, thereby uncovering the portion of the respective hole of the main body, and thereby uncovering the tongue;

sliding the tongue within the main body away from the second end of the main body and toward the first end of the main body, whereby from a perspective from which the near faces of the main body and the tongue are visible, the first portion of the tongue ceases to be behind the protrusion of the main body, rotating the tongue relative to the main body until the near face of the tongue is angled away from the near face of the main body, whereby the protrusion of the main body ceases to penetrate into the respective hole of the tongue; and withdrawing the tongue from the respective hole of the main body.

5. A disconnecting method for use with an item of jewelry, the item of jewelry having some length, the item of jewelry having along the length of the item of jewelry a number of substantially identical ingots, each of which having a characteristic shape, the item of jewelry further having a clasp shaped substantially like the characteristic shape, the clasp causing the item of jewelry to be a closed loop, the clasp comprising a main body and a tongue, the tongue having a respective shape and the main body having a respective shape, the tongue disposed to stand proud of the length of the item of jewelry connected thereto, the main body and tongue each defining a respective near face and a respective far face, the main body defining a respective hole, the tongue defining a respective hole, the main body defining first and second ends, the main body disposed to be connected to the length of the item of jewelry at the first end of the main body, the main body having a protrusion based at the second end and protruding into the respective hole of the main body and toward the first end, the protrusion being nearer the near face of the main body than the far face of the main body, the tongue with the respective hole of the tongue defining a first portion of the tongue that is nearer the far face of the tongue than the near face of the tongue, the main body having a hinged cover disposed to be moved toward the respective hole of the main body and shaped generally to cover a portion of the respective hole of the main body, the hinged cover further defining a latch holding the hinged cover in place as it covers a portion of the respective hole of the main body, the tongue seated within the main body with the near face of the tongue facing the same way as the near face of the main body and with the far face of the tongue facing the same way as the far face of the main body, the shape of the tongue and the shape of the main body such that with the tongue seated within the main body, from a perspective from which the near faces of the main body and the tongue are visible, the first portion of the tongue is behind the protrusion of the main body, the shape of the tongue and the shape of the main body such that with the tongue seated within the main body, from a perspective from which the near faces of the main body and the tongue are visible, the protrusion of the main body protrudes into the respective hole of the tongue, the hinged cover latched into place and covering the portion of the respective hole of the main body, the shape of the tongue and the shape of the main body such that the tongue and the main body are substantially space-filling, the shapes of the tongue, the main body, and the hinged cover together making up the shape of the clasp, the method comprising the steps of:

inspecting the item of jewelry with an aim of distinguishing the clasp from the ingots, and identifying the clasp;

at the clasp, unlatching and opening the hinged cover, thereby uncovering the portion of the respective hole of the main body, and thereby uncovering the tongue;

at the clasp, sliding the tongue within the main body away from the second end of the main body and toward the first end of the main body, whereby from a perspective from which the near faces of the main body and the tongue are visible, the first portion of the tongue ceases to be behind the protrusion of the main body, at the clasp, rotating the tongue relative to the main body until the near face of the tongue is angled away from the near face of the main body, whereby the protrusion of the main body ceases to penetrate into the respective hole of the tongue; and at the clasp, withdrawing the tongue from the respective hole of the main body, whereby the loop of the item of jewelry is opened.

6. The method of claim 5 wherein the item of jewelry is a necklace.

7. The method of claim 5 wherein the item of jewelry is a bracelet.

8. The method of claim 5 wherein the item of jewelry is along the length of the item of jewelry a chain.

9. The method of claim 8 wherein the chain is a Cuban chain.

10. The method of claim 5 wherein the item of jewelry is along the length of the item of jewelry a flexible cable.

11. A method for use with an item of jewelry, the item of jewelry having some length, the length of the item of jewelry defining an original length of the item of jewelry, the item of jewelry having along the length of the item of jewelry at least a first clasp and a second clasp, the first clasp shaped having a characteristic shape, the second clasp shaped having substantially the characteristic shape, the first clasp and the second clasp enabling the item of jewelry to form a closed loop, each of the first clasp and the second clasp comprising a main body and a tongue, the tongue having a respective shape and the main body having a respective shape, the tongue disposed to stand proud of the length of the item of jewelry connected thereto, the main body and tongue each defining a respective near face and a respective far face, the main body defining a respective hole, the tongue defining a respective hole, the main body defining first and second ends, the main body disposed to be connected to the length of the jewelry at the first end of the main body, the main body having a protrusion based at the second end and protruding into the respective hole of the main body and toward the first end, the protrusion being nearer the near face of the main body than the far face of the main body, the tongue with the respective hole of the tongue defining a first portion of the tongue that is nearer the far face of the tongue than the near face of the tongue, the main body having a hinged cover disposed to be moved toward the respective hole of the main body and shaped generally to cover a portion of the respective hole of the main body, the hinged cover further defining a latch holding the hinged cover in place as it covers a portion of the respective hole of the main body, the tongue seated within the main body with the near face of the tongue facing the same way as the near face of the main body and with the far face of the tongue facing the same way as the far face of the main body, the shape of the tongue and the shape of the main body such that with the tongue seated within the main body, from a perspective from which the near faces of the main body and the tongue are visible, the first portion of the tongue is behind the protrusion of the main body, the shape of the tongue and the shape of the main body such that with the tongue seated within the main body, from a perspective from which the near faces of the main body and the tongue are visible, the protrusion of the main body protrudes into the respective hole of the tongue, the hinged cover latched into place and covering the portion of the respective hole of the main body, the shape of the tongue and the shape of the main body such that the tongue and the main body are substantially space-filling, the shapes of the tongue, the main body, and the hinged cover together making up the shape of the clasp, the method comprising the steps of:

at the first clasp, unlatching and opening the hinged cover, thereby uncovering the portion of the respective hole of the main body, and thereby uncovering the tongue;

at the first clasp, sliding the tongue within the main body away from the second end of the main body and toward the first end of the main body, whereby from a perspective from which the near faces of the main body and the tongue are visible, the first portion of the tongue ceases to be behind the protrusion of the main body, at the first clasp, rotating the tongue relative to the main body until the near face of the tongue is angled away from the near face of the main body, whereby the protrusion of the main body ceases to penetrate into the respective hole of the tongue; and at the first clasp, withdrawing the tongue from the respective hole of the main body, whereby the loop of the item of jewelry is opened;

at the second clasp, unlatching and opening the hinged cover, thereby uncovering the portion of the respective hole of the main body, and thereby uncovering the tongue;

at the second clasp, sliding the tongue within the main body away from the second end of the main body and toward the first end of the main body, whereby from a perspective from which the near faces of the main body and the tongue are visible, the first portion of the tongue ceases to be behind the protrusion of the main body, at the second clasp, rotating the tongue relative to the main body until the near face of the tongue is angled away from the near face of the main body, whereby the protrusion of the main body ceases to penetrate into the respective hole of the tongue; and at the second clasp, withdrawing the tongue from the respective hole of the main body;

juxtaposing the main body of the first clasp and the tongue of the second clasp, the tongue standing proud of the length of the jewelry toward the main body, the main body extending from the length of the jewelry toward the tongue, with the tongue located near the second end of the main body and away from the first end of the main body, the near face of the main body and the near face of the tongue facing the same way, the far face of the main body and the far face of the tongue facing the same way;

moving the tongue toward the main body;

inserting the tongue into the respective hole of the main body;

positioning the tongue so that the protrusion protrudes into the respective hole of the tongue and so that the first portion of the tongue is nearer the far face of the main body than the near face of the main body, whereby from a perspective from which the near faces of the main body and the tongue are visible, the first portion of the tongue is further away than the protrusion of the main body;

sliding the tongue away from the first end of the main body and toward the second end of the main body, whereby from a perspective from which the near faces of the main body and the tongue are visible, the first portion of the tongue is behind the protrusion of the main body, whereby the protrusion of the main body penetrates into the respective hole of the tongue;

rotating the tongue relative to the main body until the near face of the tongue is substantially parallel to the near face of the main body, whereby the tongue is seated within the main body;

moving the hinged cover toward the respective hole of the main body and latching it into place, thereby covering a portion of the respective hole of the main body and thereby covering a portion of the tongue, whereby the item of jewelry again forms a closed loop of shorter length than the original length of the item of jewelry, the shorter length defining a subsequent length of the item of jewelry.

12. A method for use with first and second items of jewelry, each of the first and second items of jewelry having some respective length, each of the first and second items of jewelry having a respective clasp, the clasp of the first item of jewelry defining a first clasp, the clasp of the second item of jewelry defining a second clasp, the clasp shape having a characteristic shape, the clasp of each item of jewelry enabling the item of jewelry to form a respective closed loop, each clasp comprising a main body and a tongue, the tongue having a respective shape and the main body having a respective shape, the tongue disposed to stand proud of the respective length of the item of jewelry connected thereto, the main body and tongue each defining a respective near face and a respective far face, the main body defining a respective hole, the tongue defining a respective hole, the main body defining first and second ends, the main body disposed to be connected to the respective length of the item of jewelry at the first end of the main body, the main body having a protrusion based at the second end and protruding into the respective hole of the main body and toward the first end, the protrusion being nearer the near face of the main body than the far face of the main body, the tongue with the respective hole of the tongue defining a first portion of the tongue that is nearer the far face of the tongue than the near face of the tongue, the main body having a hinged cover disposed to be moved toward the respective hole of the main body and shaped generally to cover a portion of the respective hole of the main body, the hinged cover further defining a latch holding the hinged cover in place as it covers a portion of the respective hole of the main body, the tongue seated within the main body with the near face of the tongue facing the same way as the near face of the main body and with the far face of the tongue facing the same way as the far face of the main body, the shape of the tongue and the shape of the main body such that with the tongue seated within the main body, from a perspective from which the near faces of the main body and the tongue are visible, the first portion of the tongue is behind the protrusion of the main body, the shape of the tongue and the shape of the main body such that with the tongue seated within the main body, from a perspective from which the near faces of the main body and the tongue are visible, the protrusion of the main body protrudes into the respective hole of the tongue, the hinged cover latched into place and covering the portion of the respective hole of the main body, the shape of the tongue and the shape of the main body such that the tongue and the main body are substantially space-filling, the shapes of the tongue, the main body, and the hinged cover together making up the shape of the clasp, the method comprising the steps of:

at the first clasp, unlatching and opening the hinged cover of the first clasp, thereby uncovering the portion of the respective hole of the main body of the first clasp, and thereby uncovering the tongue of the first clasp;

at the first clasp, sliding the tongue of the first clasp within the main body of the first clasp away from the second end of the main body of the first clasp and toward the first end of the main body of the first clasp, whereby from a perspective from which the near faces of the main body of the first clasp and the tongue of the first clasp are visible, the first portion of the tongue of the first clasp ceases to be behind the protrusion of the main body of the first clasp, at the first clasp, rotating the tongue of the first clasp relative to the main body of the first clasp until the near face of the tongue of the first clasp is angled away from the near face of the main body of the first clasp, whereby the protrusion of the main body of the first clasp ceases to penetrate into the respective hole of the tongue of the first clasp; and at the first clasp, withdrawing the tongue of the first clasp from the respective hole of the main body of the first clasp, whereby the loop of the first item of jewelry is opened;

at the second clasp, unlatching and opening the hinged cover of the second clasp, thereby uncovering the portion of the respective hole of the main body of the second clasp, and thereby uncovering the tongue of the second clasp;

at the second clasp, sliding the tongue of the second clasp within the main body of the second clasp away from the second end of the main body of the second clasp and toward the first end of the main body of the second clasp, whereby from a perspective from which the near faces of the main body of the second clasp and the tongue of the second clasp are visible, the first portion of the tongue of the second clasp ceases to be behind the protrusion of the main body of the second clasp, at the second clasp, rotating the tongue of the second clasp relative to the main body of the second clasp until the near face of the tongue of the second clasp is angled away from the near face of the main body of the second clasp, whereby the protrusion of the main body of the second clasp ceases to penetrate into the respective hole of the tongue of the second clasp; and at the second clasp, withdrawing the tongue of the second clasp from the respective hole of the main body of the second clasp, whereby the loop of the second item of jewelry is opened;

juxtaposing the main body of the first clasp and the tongue of the second clasp, the tongue of the second clasp standing proud of the length of the jewelry toward the main body of the first clasp, the main body of the first clasp extending from the length of the jewelry toward the tongue of the second clasp, with the tongue of the second clasp located near the second end of the main body of the first clasp and away from the first end of the main body of the first clasp, the near face of the main body of the first clasp and the near face of the tongue of the second clasp facing the same way, the far face of the main body of the first clasp and the far face of the tongue of the second clasp facing the same way;

moving the tongue of the second clasp toward the main body of the first clasp;

inserting the tongue of the second clasp into the respective hole of the main body of the first clasp;

positioning the tongue of the second clasp so that the protrusion of the main body of the first clasp protrudes into the respective hole of the tongue of the second clasp and so that the first portion of the tongue of the second clasp is nearer the far face of the main body of the first clasp than the near face of the main body of the first clasp, whereby from a perspective from which the near faces of the main body of the first clasp and the tongue of the second clasp are visible, the first portion of the tongue of the second clasp is further away than the protrusion of the main body of the first clasp;

sliding the tongue of the second clasp away from the first end of the main body of the first clasp and toward the second end of the main body of the first clasp, whereby from a perspective from which the near faces of the main body of the first clasp and the tongue of the second clasp are visible, the first portion of the tongue of the second clasp is behind the protrusion of the main body of the first clasp, whereby the protrusion of the main body of the first clasp penetrates into the respective hole of the tongue of the second clasp;

rotating the tongue of the second clasp relative to the main body of the first clasp until the near face of the tongue of the second clasp is substantially parallel to the near face of the main body of the first clasp, whereby the tongue of the second clasp is seated within the main body of the first clasp;

moving the hinged cover of the first clasp toward the respective hole of the main body of the first clasp and latching it into place, thereby covering a portion of the respective hole of the main body of the first clasp and thereby covering a portion of the tongue of the second clasp;

juxtaposing the main body of the second clasp and the tongue of the first clasp, the tongue of the first clasp standing proud of the length of the jewelry toward the main body of the second clasp, the main body of the second clasp extending from the length of the jewelry toward the tongue of the first clasp, with the tongue of the first clasp located near the second end of the main body of the second clasp and away from the first end of the main body of the second clasp, the near face of the main body of the second clasp and the near face of the tongue of the first clasp facing the same way, the far face of the main body of the second clasp and the far face of the tongue of the first clasp facing the same way;

moving the tongue of the first clasp toward the main body of the second clasp;

inserting the tongue of the first clasp into the respective hole of the main body of the second clasp;

positioning the tongue of the first clasp so that the protrusion of the main body of the second clasp protrudes into the respective hole of the tongue of the first clasp and so that the first portion of the tongue of the first clasp is nearer the far face of the main body of the second clasp than the near face of the main body of the second clasp, whereby from a perspective from which the near faces of the main body of the second clasp and the tongue of the first clasp are visible, the first portion of the tongue of the first clasp is further away than the protrusion of the main body of the second clasp;

sliding the tongue of the first clasp away from the first end of the main body of the second clasp and toward the second end of the main body of the second clasp, whereby from a perspective from which the near faces of the main body of the second clasp and the tongue of the first clasp are visible, the first portion of the tongue of the first clasp is behind the protrusion of the main body of the second clasp, whereby the protrusion of the main body of the second clasp penetrates into the respective hole of the tongue of the first clasp;

rotating the tongue of the first clasp relative to the main body of the second clasp until the near face of the tongue of the first clasp is substantially parallel to the near face of the main body of the second clasp, whereby the tongue of the first clasp is seated within the main body of the second clasp;

moving the hinged cover of the main body of the second clasp toward the respective hole of the main body of the second clasp and latching it into place, thereby covering a portion of the respective hole of the main body of the second clasp and thereby covering a portion of the tongue of the first clasp;

whereby the first item of jewelry together with the second item of jewelry together form a single closed loop having a length greater than the length of either item of jewelry taken alone.

13. The method of claim 12 wherein each item of jewelry is a necklace.

14. The method of claim 12 wherein each item of jewelry is a bracelet.

15. The method of claim 12 wherein each item of jewelry is along the length of the item of jewelry a chain.

16. The method of claim 15 wherein the chain is a Cuban chain.

17. The method of claim 12 wherein each item of jewelry is along the length of the item of jewelry a flexible cable.

18. The method of claim 12 wherein at the original length of the item of jewelry, the item of jewelry is a necklace, and at the subsequent length of the item of jewelry, the item of jewelry is a bracelet.

19. The method of claim 12 wherein the first item of jewelry is a bracelet, and wherein the second item of jewelry is a bracelet, and wherein the single closed loop of greater length is a necklace.

20. The method of claim 12 wherein each item of jewelry is a necklace.

21. The method of claim 12 wherein each item of jewelry is a bracelet.

22. The method of claim 12 wherein each item of jewelry comprises a chain.

23. The method of claim 12 wherein each item of jewelry comprises a flexible cable.

24. A clasp for an item of jewelry, comprising:

a main body, wherein:

said main body has top, bottom, front, rear, right, and left sides, the top side of said main body defining a top surface, said main body is adapted to be coupled to an end of a chain for an item of jewelry, said main body has a through-hole extending from the top side of the main body to the bottom side of the main body, and said main body has a main-body protrusion disposed from the right side of said main body and horizontally into and over a portion of said through-hole; and a tongue, said tongue having a tongue base and a mating projection, wherein:

said tongue base is adapted to be coupled to an end of a chain for an item of jewelry, said mating projection includes two extended members separated by a space that is sized to be inserted into said through-hole and to receive said main-body protrusion when the clasp is engaged, each of said two extended members having a distal end, and said two extended members are joined at the distal end with a joining member that extends downward and is sized to substantially fill said through-hole when the clasp is engaged with said protrusion disposed above said joining member;

wherein when the mating projection of the tongue is inserted into said through-hole and rotated back to a fully seated position relative to said main body and slidably positioned to engage said protrusion with said main body, the fully seated tongue having an upper surface:

said joining member is disposed to fill said through-hole to substantially form a flat contiguous bottom surface with said main body and said tongue, the upper surface of said fully seated tongue lies in a flat plane relative to the top surface of said main body, and said protrusion on said main body overlaps the joining member of the tongue within said space separating said two extended members on said mating projection.

25. The clasp for an item of jewelry of claim 24, further comprising a hinged cover that is adapted to be closed over and releasably latched over said main body while fully engaged with said fully seated tongue.

26. The clasp for an item of jewelry of claim 25, wherein said main body and hinged cover include ornamentation selected from the group consisting of writing, iconography, engraving, and any combination thereof.

27. The clasp for an item of jewelry of claim 24, wherein said main body is coupled to an end of a chain for an item of jewelry via a means selected from the group consisting of welding, clamping with fasteners, tying, gluing, and interference fit.

28. The clasp for an item of jewelry of claim 24, the tongue having a base, wherein said base of said tongue is coupled to an end of a chain for an item of jewelry via a means selected from the group consisting of welding, clamping with fasteners, tying, gluing, and interference fit.

29. The clasp for an item of jewelry of claim 24, said main body having top-right side edges, wherein the top-right side edges of said main body are sloped downward to help facilitate the engagement with said tongue.

30. The clasp for an item of jewelry of claim 24, wherein edges at a top-distal end of the mating projection of the tongue are sloped downward to help facilitate easier insertion of said tongue into said main body via said through-hole.

31. An item of jewelry comprising at least one clasp according to claim 24 and at least one chain.

32. The item of jewelry of claim 31, comprising a plurality of said clasps such that multiple lengths of chain are used and coupled via said plurality of said clasps, the item of jewelry defining an effective length, such that the effective length of the item of jewelry can be varied by a user by adding or removing one of more lengths of chain and an associated clasp.

33. The item of jewelry of claim 32, wherein said item of jewelry is of a type selected from the group consisting of necklace, bracelet, and anklet.

34. The item of jewelry of claim 32, wherein said item of jewelry is a Cuban link chain.

35. The item of jewelry of claim 31, wherein said at least one chain for an item of jewelry is selected from the group consisting of metal chains, string, leather cord, other cordage, and a linked series of charms or ingots.

36. The item of jewelry claim 31, wherein said at least one clasp further comprises a hinged cover that is adapted to be closed over and releasably latched over the main body of said at least one clasp while fully engaged with said fully seated tongue.

37. The item of jewelry of claim 36, wherein the main body and hinged cover of said at least one clasp include ornamentation selected from the group consisting of writing, iconography, engraving, and any combination thereof.

38. The item of jewelry of claim 37, further comprising at least one non-clasp charm or ingot, wherein said at least one clasp is sized, shaped, and ornamented to look like at least one of said non-clasp charm or ingot that is part of said item of jewelry.

39. The item of jewelry of claim 38, wherein said at least one clasp and each of said at least one non-clasp charm or ingot are identically ornamented.

40. The item of jewelry of claim 31, wherein said main body and said tongue of said at least one clasp are each coupled to an end of a chain via a means selected from the group consisting of welding, clamping with fasteners, tying, gluing, and interference fit.

41. The item of jewelry of claim 31, wherein the main body of said at least one clasp has top-right side edges, and wherein the top-right side edges of the main body of said at least one clasp are sloped downward to help facilitate engagement with the tongue of said at least one clasp.

42. The item of jewelry of claim 31, wherein the mating projection of the tongue has a top-distal end, and wherein the top-distal end of the mating projection of the tongue has edges, and wherein the edges at the top-distal end of the mating projection of the tongue of said at least one clasp are sloped downward to help facilitate easier insertion of the tongue of said at least one clasp into the main body via said through-hole of said at least one clasp.

* * * * *